United States Patent [19]

Thomas

[11] 4,455,557

[45] Jun. 19, 1984

[54] DISHED REFLECTOR AND METHOD OF MAKING SAME

[76] Inventor: John Thomas, 11 Sussex St. North, Lindsay, Ontario, Canada

[21] Appl. No.: 384,214

[22] Filed: Jun. 2, 1982

[51] Int. Cl.[3] ..... H01Q 15/16

[52] U.S. Cl. ..... 343/912; 29/600; 72/379

[58] Field of Search ..... 343/912, 907, 915, 914; 72/379, 377; 29/600, 825, 163.5 R; 428/131, 136

[56] References Cited

U.S. PATENT DOCUMENTS

| | | | |
|---|---|---|---|
| 2,181,181 | 4/1939 | Gerhard | 343/916 |
| 2,423,863 | 8/1947 | Wales | 29/163.5 R |
| 2,460,869 | 10/1949 | Braden | 343/912 |
| 3,521,837 | 11/1970 | Pabst | 29/163.5 R |
| 3,618,185 | 7/1971 | Coen | 29/163.5 R |
| 4,021,817 | 3/1977 | Shibano et al. | 343/912 |

*Primary Examiner*—Eli Lieberman
*Assistant Examiner*—Karl Ohralik
*Attorney, Agent, or Firm*—Fetherstonhaugh & Co.

[57] ABSTRACT

A reflector and a method of making a reflector, the reflector having a dished reflecting surface, a series of slot formations, the extended longitudinal axis of each slot formation being curved and radiating from the center area of the reflecting surface and through the outer edge of the reflecting surface, the material of the reflector laterally of the extended longitudinal axes of said slot formations adjacent at least one end of the slot formations being folded adjacent the extended axes of the slot formations.

7 Claims, 5 Drawing Figures

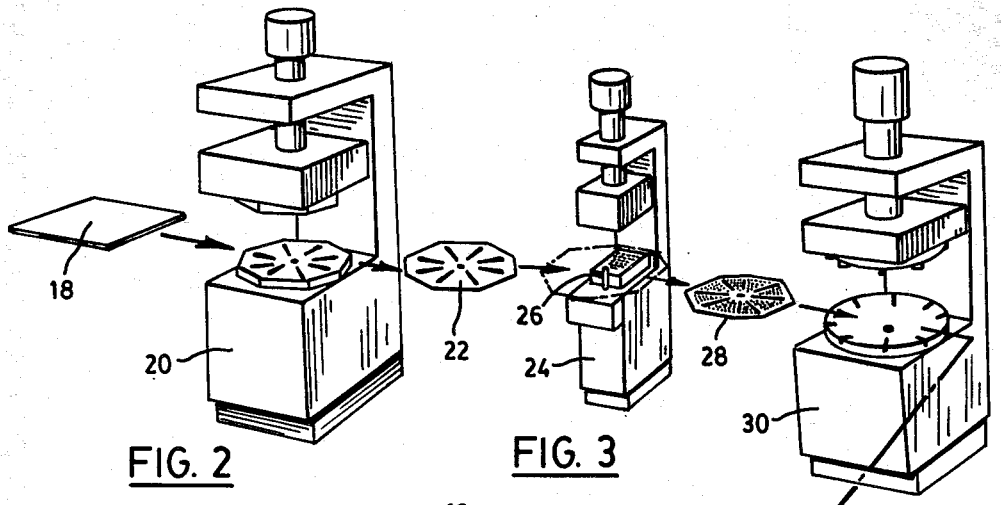
FIG. 2
FIG. 3
FIG. 4
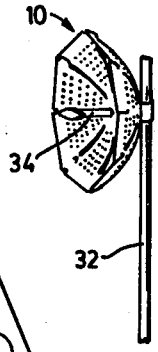
FIG. 5
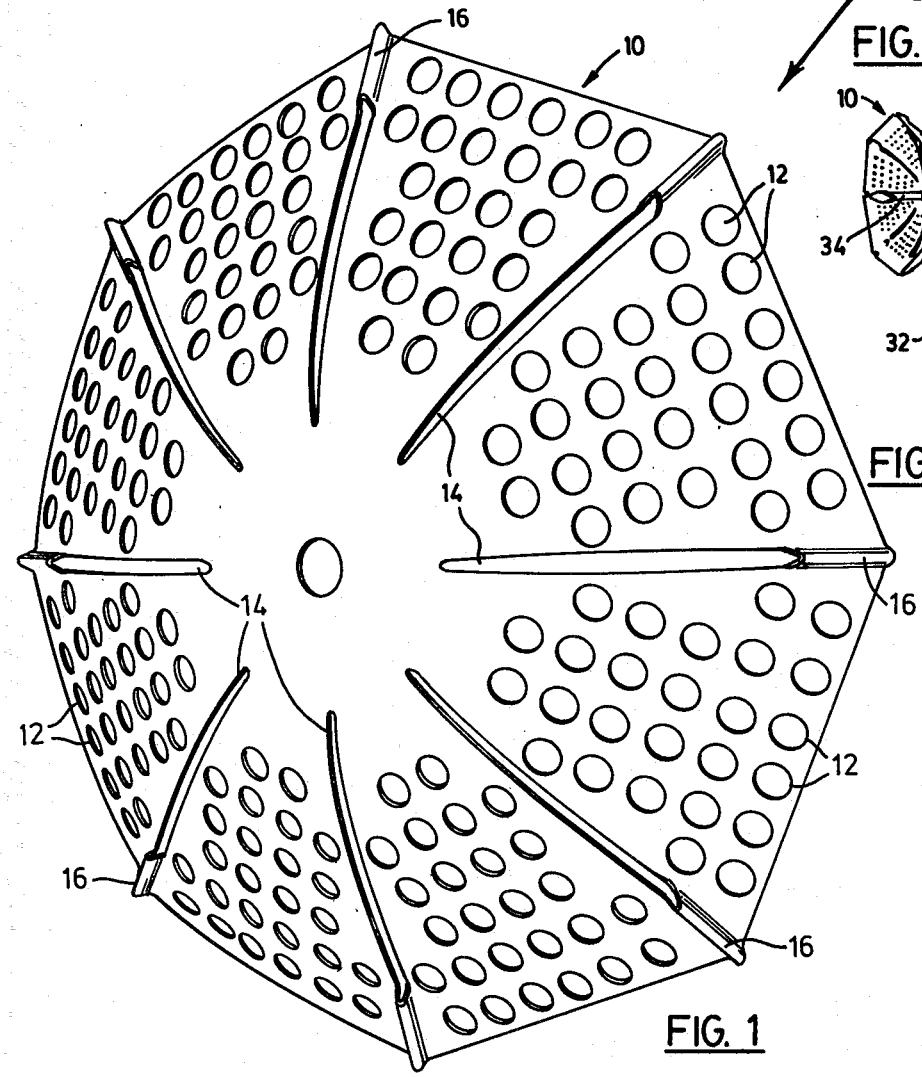
FIG. 1

DISHED REFLECTOR AND METHOD OF MAKING SAME

This invention relates to a reflector of the type used for microwave and VHF antennas.

Reflectors of the general class to which this invention relates are customarily spun from a material such as aluminum or formed on a hydro forming press. Each of these methods of making a dished reflector has its disadvantages. Spinning as a method for making a dished reflector requires that the reflector be made from a metal that can be drawn or spun such as aluminum. This is a limitation and it often results in higher costs. In many configurations, it is often necessary to anneal the metal during the spinning process. This adds cost. Moreover, it is common practice to form the reflecting surface of a reflector with holes to reduce wind resistance. One cannot form holes in a spun reflector before spinning.

Hydro forming is a satisfactory way of pressing these reflectors in large quantities. The reflector can be made of any metal and it can be formed with wind resistance reducing holes, but the equipment is so expensive that it is not readily available. The expense of the equipment obviously adds to the cost of the product as well as availability of the method.

It is an object of this invention to provide a method for making a dished reflector and a dished reflector wherein wind resistant holes can be incorporated into the structure and where a wide variety of metals can be used. It is also an object of the invention to provide a method for making a product that is inexpensive and that can be practised on widely available equipment.

With these and other objects in view, a method of making a dished reflector according to the invention comprises the steps of forming a blank from a piece of blank press formable stock, cutting a series of slot formations in said blank, the extended longitudinal axis of each slot formation radiating generally from the centre area of the blank through the outer edge of the blank, pressing the blank into the shape of a dished reflector and simultaneously folding the material of the blank laterally of the extended longitudinal axes of said slot formations adjacent at least one end of the slot formation whereby to narrow the width of the slot formation and pull in the blank into a surface of revolution which will act to concentrate signals or energy into a focal area.

A dished reflector formed from a blank of formable material according to this invention comprises a dished reflecting surface, a series of slot formations, the extended longitudinal axis of each slot formation being curved and radiating from the centre area of the reflecting surface and through the outer edge of the reflecting surface, the material of the reflector laterally of the extended longitudinal axes of said slot formations adjacent at least one of the slot formations being folded about the extended axes of the slot formations.

The invention will be clearly understood after reference to the following detailed specification read in conjunction with the drawings.

In the drawings

FIG. 1 is a perspective illustration of a dished reflector according to the invention;

FIGS. 2, 3 and 4 are schematic illustrations showing the making of the reflector;

FIG. 5 is an illustration of a reflector mounted as for use.

Referring to the drawings, the numeral 10 generally refers to a dished reflector according to the invention. It has a dished reflecting surface that is formed with holes 12 for the purpose of reducing wind resistance in use. The provision of holes for this purpose is not new and no claim is being made to the novelty of the holes of themselves. It is, however, significant that the method of the invention is capable of simply providing a reflector that has these holes. It will be recalled from the preamble of the specification that the prior art includes the method of spinning these reflectors from metals such as aluminum. With the spinning operation, it is not possible to provide holes in the dished reflector prior to spinning.

The dished reflector illustrated has a series of eight slot formations 14 which divide the peripheral portion of the reflecting surface into eight segments. The segments are joined at their outer extremities by a section 16 in the form of a U-shaped rib. Eight is chosen only as an example, and otherwise may be any other minimum number of slots as would be required in order to accomplish a particular size of dished reflector surface.

FIGS. 2 to 4 illustrate the manufacture of a reflector from a blank piece of metal. This metal can be any formable material. Aluminum having a thickness of about 0.030 inches is satisfactory. However, steel could be used provided that it is press formable. A person skilled in the art would not have any difficulty in selecting the appropriate material for any particular application.

The diameter of a reflector for microwave antenna use is commonly between 15 and 36 inches. The method, however, can be used in any size subject to mechanical strength. Sizes up to three to six feet in diameter are contemplated.

A rectangular metal blank 18 is cut in a press 20 to the octagonal slotted shape 22. In press 24 the shape 22 is indexed about a pin 26 to separately stamp the holes 12 in each of the eight segments whereby to provide a punched and slotted blank 28. The blank 28 is then pressed to form the dished reflector 10 by cooperating male and female dies in press 30 with one hit per slot.

FIG. 5 is illustrative of a reflector 10 mounted on a mast 32 with an antenna 34 in place.

The method of making the dish reflector is simple in the sense that a complex shape of substantial size can be stamped with simple procedures and inexpensive equipment. The provision of the radially extending slots 14 of a form such that the metal that lies laterally of the extended axis thereof can be formed to fold around the slot axis in a U-shape 16 or other convenient fold, permits the reflector to be formed in a press 30 of low capacity. The manner of folding or gathering the material at the U-shaped rib 16 is not critical. It could be a U-shape, it could be pleated or anything inbetween. The object is to reduce the width of the slot and permit the easy formation of the reflecting surface. The indexing and punching of the holes by means of the press 24 is, of itself, a common operation and can be carried out in a press of about 50 to 60 ton capacity. Press 20 is of standard design and readily available.

The configuration of the reflector is capable of variation and the design illustrated wherein there is one U-shaped rib at the outer extremity of the slots 14 is not intended to be a limitation. One might, for example, have more than one U-shaped rib along a given slot axis that included more than one slot on a common axis for a larger reflector design.

Embodiments of the invention other than the one illustrated will be apparent to those skilled in the art and it is not intended that the specification should be read in a limiting sense.

The embodiments of the invention in which an exclusive property or privilege is claimed are defined as follows:

1. A method of making a dished reflector comprising the steps of:

forming a blank from a piece of blank press formable stock;

cutting a series of slot formations in said blank, the extended longitudinal axis of each slot formation radiating generally from the centre area of the blank through the outer edge of the blank;

pressing the blank into the shape of a dished reflector and simultaneously folding the material of the blank laterally of the extended longitudinal axes of said slot formations adjacent at least one end of the slot formations whereby to narrow the width of the slot formation.

2. A method of making a dished reflector as claimed in claim 1 in which the longitudinal axes of said slots extend radially of the centre of said blank, said material being folded as aforesaid into U-shaped ribs.

3. A method of making a dished reflector as claimed in claim 2 in which the longitudinal axes of said slots extend radially of the centre of said blank, said U-shaped ribs being formed only adjacent the outer end of said radial slots.

4. A method of making a dished reflector as claimed in claim 2 in which said slot formations comprise a plurality of distant slots along the longitudinal axes of their respective slot formations, the metal of the blank laterally of the longitudinal axes of the slot formations between the distinct slots of a slot formation being formed to a U-shape as aforesaid.

5. A dished reflector formed from a blank of formable material comprising:

a dished reflecting surface;

a series of slot formations, the extended longitudinal axis of each slot formation being curved and radiating from the centre area of the reflecting surface and through the outer edge of the reflecting surface;

the material of the reflector laterally of the extended longitudinal axes of said slot formations adjacent at least one end of the slot formations being folded adjacent the extended axes of the slot formations.

6. A dished reflector as claimed in claim 5 wherein the material of the reflector laterally of the extended longitudinal axes of said slot formations adjacent at least one end of the slot formations is folded as aforesaid to form a U-shaped rib about the extended axes of the slot formations.

7. A dished reflector as claimed in claim 6 wherein said U-shaped ribs are formed only adjacent the outer end of said radial slots.

* * * * *